US012209221B2

(12) United States Patent
Gillis et al.

(10) Patent No.: US 12,209,221 B2
(45) Date of Patent: Jan. 28, 2025

(54) INTEGRATED MIXED PLASTIC PYROLYSIS WITH HEAVY OIL PRODUCT THERMAL CRACKING

(71) Applicant: LUMMUS TECHNOLOGY LLC, Houston, TX (US)

(72) Inventors: Daniel Bruce Gillis, Houston, TX (US); Sudipto Chakraborty, Houston, TX (US); Manoj Roy Som, Houston, TX (US); Liang Chen, Houston, TX (US); Fredy Antonio Cabrales, Houston, TX (US)

(73) Assignee: Lummus Technology LLC, Houston, TX (US)

( * ) Notice: Subject to any disclaimer, the term of this patent is extended or adjusted under 35 U.S.C. 154(b) by 0 days.

(21) Appl. No.: 18/300,096

(22) Filed: Apr. 13, 2023

(65) Prior Publication Data

US 2023/0332051 A1 Oct. 19, 2023

Related U.S. Application Data

(60) Provisional application No. 63/362,929, filed on Apr. 13, 2022.

(51) Int. Cl.

| | |
|---|---|
| ***C10G 1/00*** | (2006.01) |
| ***C10G 1/10*** | (2006.01) |
| ***C10G 55/04*** | (2006.01) |

(52) U.S. Cl.

CPC ..... *C10G 1/002* (2013.01); *C10G 1/10* (2013.01); *C10G 55/04* (2013.01); *C10G 2300/1003* (2013.01); *C10G 2300/4081* (2013.01)

(58) Field of Classification Search

None

See application file for complete search history.

(56) References Cited

U.S. PATENT DOCUMENTS

| | | | | |
|---|---|---|---|---|
| 2,756,186 | A * | 7/1956 | Slover | C10G 55/04 208/125 |
| 6,822,126 | B2 | 11/2004 | Miller | |
| 8,471,079 | B2 | 6/2013 | Brandvold et al. | |
| 2015/0080624 | A1 | 3/2015 | Gephart et al. | |

(Continued)

FOREIGN PATENT DOCUMENTS

| | | | | |
|---|---|---|---|---|
| GB | 2138840 | A * | 10/1984 | C10G 51/023 |
| WO | WO-2020252228 | A1 * | 12/2020 | C10B 49/22 |

(Continued)

OTHER PUBLICATIONS

K-H Lee "Thermal degradation of heavy pyrolytic oil in a batch and continuous reaction system" Journal of Analytical and Applied Pyrolysis 86 (2009) 348-353 (Year: 2009).*

(Continued)

*Primary Examiner* — In Suk C Bullock
*Assistant Examiner* — Alyssa L Cepluch
(74) *Attorney, Agent, or Firm* — Osha Bergman Watanabe & Burton LLP

(57) ABSTRACT

Systems and processes for converting waste plastics and other waste materials to useful end products. The systems integrate a plastics pyrolysis reactor and a liquid phase thermal cracking reactor to advantageously process the waste plastics to form various hydrocarbon products.

14 Claims, 5 Drawing Sheets

(56) References Cited

U.S. PATENT DOCUMENTS

| | | | | |
|---|---|---|---|---|
| 2016/0024390 | A1* | 1/2016 | Ullom | C10G 1/086 202/99 |
| 2021/0332299 | A1* | 10/2021 | Timken | C10G 1/10 |
| 2023/0089058 | A1* | 3/2023 | Polasek | C10G 1/10 585/241 |

FOREIGN PATENT DOCUMENTS

| | | | |
|---|---|---|---|
| WO | 2021-163113 | A1 | 8/2021 |
| WO | 2021-216284 | A1 | 10/2021 |

OTHER PUBLICATIONS

International Search Report issued in International Application No. PCT/US2023/018505 dated Aug. 7, 2023 (4 pages).
Written Opinion issued in International Application No. PCT/US2023/018505 dated Aug. 7, 2023 (6 pages).

* cited by examiner

INTEGRATED MIXED PLASTIC PYROLYSIS WITH HEAVY OIL PRODUCT THERMAL CRACKING

FIELD OF THE DISCLOSURE

Embodiments of the present disclosure generally relate to the conversion of waste plastics to petrochemicals, fuels, and other useful intermediates and products.

BACKGROUND

Embodiments of the present disclosure generally relate to the conversion of waste plastics to petrochemicals, fuels, and other useful intermediates and products. There has been a rapid and growing environmental concern regarding the need to recover and recycle plastic wastes. Plastic pyrolysis technology, however, is at an early stage of development in the industry. Several challenges exist with plastics recycling, however, including the quality of the products of recycled or converted materials, as well as a desire to have truly circular end products that are not commingled with non-renewable derived feedstocks.

SUMMARY OF THE CLAIMED EMBODIMENTS

Embodiments herein relate to thermochemical processes and systems useful to convert waste plastics to petrochemicals, fuels, and other intermediates or end products.

In one aspect, embodiments disclosed herein relate to a process for converting waste plastics to hydrocarbon products. The process includes heating a waste plastic to form a heated molten plastic, and feeding the heated molten plastic to a plastics pyrolysis reaction zone. In the plastics pyrolysis reaction zone, the heated molten plastic is further heated to a pyrolysis temperature, producing a pyrolysis oil product and a liquid pitch product. The process also includes feeding a heavy pyrolysis oil to a thermal cracking heater. In the thermal cracking heater, the process includes thermally cracking the heavy pyrolysis oil while maintaining the heavy pyrolysis oil in a liquid phase to form a thermally cracked product. The process further includes separating the pyrolysis oil product and the thermally cracked product into a pyrolysis gas fraction, a light pyrolysis oil fraction, a medium pyrolysis oil fraction, and a heavy pyrolysis oil fraction. A first portion of the heavy pyrolysis oil fraction is used as the heavy pyrolysis oil fed to thermal cracking heater.

In another aspect, embodiments herein relate to a process for converting waste plastics to hydrocarbons. The process includes, in a thermal cracking heater, thermally cracking a heavy pyrolysis oil while maintaining the heavy pyrolysis oil in a liquid phase to form a thermally cracked product. The thermally cracked product and a plastic pyrolysis oil are commonly separated to recover a pyrolysis gas fraction, a light pyrolysis oil fraction, a medium pyrolysis oil fraction, and a heavy pyrolysis oil fraction. A first portion of the heavy pyrolysis oil fraction is fed to the thermal cracking heater as the heavy pyrolysis oil. A second portion of the heavy pyrolysis oil fraction is mixed with a molten plastic to form a molten plastic mixture. In a plastic pyrolysis reaction zone, the molten plastic mixture is heated to a pyrolysis temperature, producing a pyrolysis oil product and a liquid pitch product. The process also includes quenching the pyrolysis oil product with a portion of the medium pyrolysis oil fraction to form the plastic pyrolysis oil.

In a further aspect, embodiments herein relate to a system for converting waste plastics to lighter hydrocarbons. The system includes a melt tank, a pyrolysis reaction zone, a liquid phase thermal cracking heater, and a separation system. The melt tank is configured for melting a feed stream comprising waste plastic to produce a molten plastic. The pyrolysis reaction zone is configured for pyrolyzing the molten plastic to produce a pyrolysis oil reaction product and a liquid pitch product. The liquid phase thermal cracking heater is configured for thermally cracking a heavy pyrolysis oil while maintaining the heavy pyrolysis oil in a liquid phase to form a thermally cracked product. And, the separation system is configured for separating the thermally cracked product and the pyrolysis oil reaction product to recover a pyrolysis gas fraction, a light pyrolysis oil fraction, a medium pyrolysis oil fraction, and a heavy pyrolysis oil fraction. The system also includes a feed line for conveying a portion of the heavy pyrolysis oil fraction to the liquid phase thermal cracking heater as the heavy pyrolysis oil.

Other aspects and advantages will be apparent from the following description and the appended claims.

DETAILED DESCRIPTION

Figure 1:
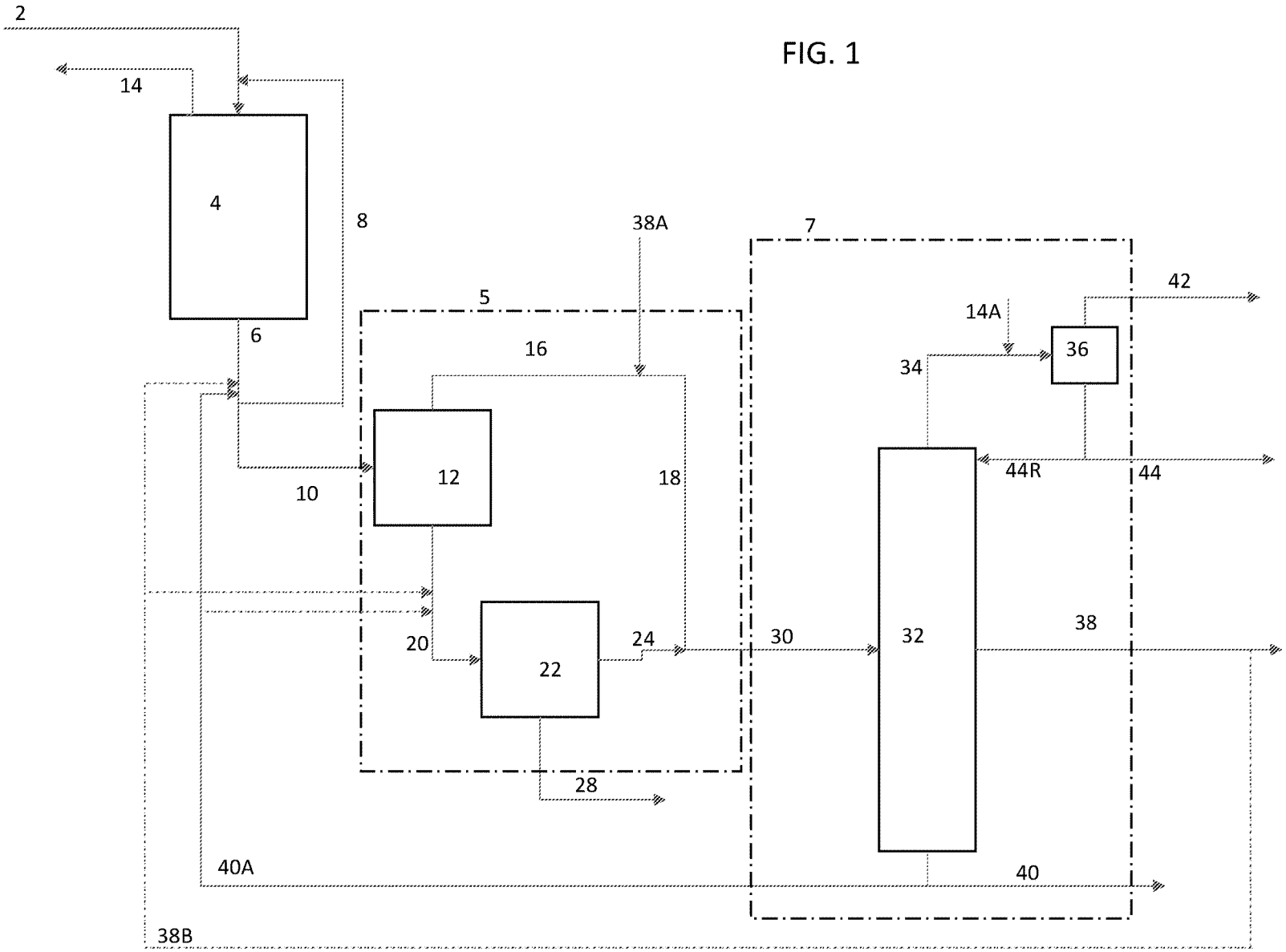
FIG. 1 illustrates a simplified process flow diagram of a system for plastics pyrolysis according to one or more embodiments disclosed herein.

Embodiments herein are directed toward thermochemical processes to convert waste plastics to useful petrochemicals, fuels, and other intermediates or end products. More specifically, embodiments herein are directed toward the conversion of waste plastics via an integrated process including plastic pyrolysis and thermal cracking. Embodiments herein may also be directed toward integration of plastic (and other waste stream) pyrolysis with heavy oil product thermal cracking to produce suitable liquid product for processing in ethylene liquid crackers.

Embodiments herein may include plastic pyrolysis followed by separating out pyrolysis product heavy oil components and both recycling heavy oil components back to the plastics feed melt section and thermally cracking the heavy oil in a high severity thermal cracking section. The thermal cracking products are combined with pyrolysis section products. In some embodiments, unconverted heavy oil may be recycled to extinction and any undesirable components produced, such as thermal tar, are purged from the integrated process. In other embodiments, the heavy oil product may be combined with the partially converted plastic from the pyrolysis reactor ("first stage") and the combined stream thermally cracked with part of its feed produced as a heavy oil product. In yet other embodiments, the heavy oil product may be vacuum fractionated, producing a smaller volume pitch product and the recovered distillable products may be fed to the thermal cracking section for further conversion. These and other embodiments of the integrated processes are illustrated in the Figures and described further below.

Polymers that may be pyrolyzed to form a waste plastic pyrolysis oil may include thermoplastics, thermosets, and elastomers. For example, waste material undergoing pyrolysis to form a waste plastic pyrolysis oil may include polystyrene, polypropylene, polyphenylene sulfide, polyphenylene oxide, polyethylene, polyetherimide, polyether ether ketone, polyoxymethylene, polyether sulfone, polycarbonate, polybenzimidazole, polylactic acid, nylon, and acrylic polymers such as poly methyl methacrylic acid (PMMA), among many other thermoplastics. Waste plastic pyrolysis oils useful herein may also be formed from various unsaturated or saturated elastomers and rubbers known in the art, such as polybutadiene, isoprene, styrene-butadiene, ethylene vinyl acetate, and many, many others. Embodiments herein may be robust enough to process some quantity of heteroatom-containing polymers, including those listed above as well as others known in the art; however, a heteroatom content of the resulting waste plastic pyrolysis oil should typically be, but is not limited to, less than 2 wt %, such as less than 1 wt % or less than 0.5 wt %.

The waste plastic may be converted to a pyrolysis oil using systems according to embodiments herein. The systems may include, as primary components, a melt tank, a plastics pyrolysis reactor or a plastics pyrolysis reactor train, and a thermal cracker. The system may also include a waste plastic feed system, a pyrolysis oil separation system, and one or more heating systems, as will be described below.

In general, the waste plastic feed system is a system configured to provide a waste plastic feed to the melt tank, and is not particularly limited, as many different configurations may be used. In some embodiments, a waste plastic feed system may include a feed hopper, which may be filled with a quantity of waste plastic, such as in the form of chips, pellets, flakes, attenuated fibers, shredded plastic, and other forms of waste plastic as may be received from a recycler or other supplier of waste plastics. The feed hopper may be fluidly connected to a screw conveyor or other means for metering and conveying the waste plastic to the melt tank. In some embodiments, the waste plastic feed system may include an extruder, which may be a single or double screw type, and may heat and partially or fully melt the waste plastic by viscous dissipation of the mechanical energy supplied by a motor to a rotating screw.

In general, it is desired to limit the amount of water and oxygen fed to the melt tank and the pyrolysis reactor. The screw conveyor and/or the feed hopper or associated flow lines may be connected to a hot nitrogen supply system, such that the polymer may be heated to a temperature sufficient to remove water, but not so high as to melt the polymers, venting a nitrogen stream containing water vapor and any oxygen as may be displaced.

The dried waste plastic may then be fed to the melt tank, wherein the waste plastic is heated to a temperature sufficient to melt the plastic but low enough so as to avoid any significant conversion of the waste plastic, as it is preferred to control the reaction and resulting reaction products via conversion in the pyrolysis reactor. In some embodiments, the waste plastic may be heated in an extruder and may be fed to the melt tank in a heated, partially molten or fully molten condition. The waste plastic may then be heated, or further heated, in the melt tank to a temperature in the range from about 200° C. to about 375° C., such as about 300° C. The temperature of the molten plastic should be high enough to melt the plastic and provide a molten plastic of a desired viscosity, facilitating transport between unit operations, but, as noted above, low enough to limit or avoid conversion of the plastics within the melt tank.

The melt tank may be an agitated vessel. The vessel may include an inlet for receiving a feed stream comprising waste plastic from the waste plastic feed system, as well as an outlet for conveying or outputting the resulting molten plastic. In some embodiments, the melt tank or melt system may include an inlet for receiving a heavy oil recycle stream recovered from plastic pyrolysis reactor effluents, where the heavy oil may aid processing and melting of the waste plastic in the melt system. The melt tank may also include a vapor outlet for venting any gases produced in the melt tank or expelled from the waste plastic, such as may be entrained with the feed or resulting from the heating of the waste plastics. The melt tank vessel may include a heating system for heating the waste plastic from a feed temperature to a melt temperature. The heating system may include one or both of an external jacket and internal coils to provide heat for melting the waste plastic.

Following melting of the waste plastic, the molten plastic may be fed to a pyrolysis reactor or a pyrolysis reactor train for converting the molten plastic into a pyrolysis oil product and a pitch product. Embodiments herein may utilize a single stage plastic pyrolysis reactor, having a single reactor targeting 50% to 80% conversion, for example, or may include multiple reactors in series, in parallel, or both.

A single stage plastics pyrolysis reactor may include an inlet configured to receive the molten plastic, a first outlet for recovering the pyrolysis oil and pyrolysis gas, and a second outlet for recovering the pitch product. The pyrolysis reactor may also include a heating system configured to heat the molten plastic from the inlet temperature to a pyrolysis temperature. The molten plastic may be heated within the pyrolysis reactor up to a temperature, for example, in the range from about 350° C. to about 700° C., such as from about 370° C. (700° F.) to about 675° C. (1250° F.), such as from 350° C. (662° F.) to 550° C. (1022° F.), and at a pressure in the range from about 0.3 barg (4 psig) to about 1.4 barg (20 psig), such as about 0.4 barg (6 psig).

In some embodiments, a pyrolysis reactor heating system includes a pre-heat section and a reaction section (section, zone, or stage may be used interchangeably when discussing reactors herein). The pre-heat section may be configured to heat the molten plastic up to a first pyrolysis temperature, targeting a low conversion, such as 5-20 wt % conversion, for example 10 wt % conversion (conversions herein are wt % unless otherwise noted). Following the pre-heat section, the molten plastic is processed in the reaction section to convert a significant portion of the plastic to pyrolysis oil. The pyrolysis temperature and residence time may target a reaction section conversion in the range from 30 wt % to 80 wt % conversion, such as 70 wt % conversion. Overall conversion of the waste plastics to pyrolysis gas and pyrolysis oil may be, for example, greater than 80 wt %, greater than 85 wt %, greater than 90 wt %, and up to 95 wt % or 97 wt % in some embodiments, where the remainder of the waste plastic may be recovered from the pyrolysis reactor as a pitch product.

In other embodiments, a pyrolysis reaction train includes two reactors in series. In the first reaction stage, similar to the embodiment reactor above, the conditions may be controlled to target 50% to 70% conversion. Unconverted residue including polymer melt and other liquids from the first reaction stage are then be fed to a second reaction stage where the conversion is further increased, such as to 70%-93% or more, and a heavy residue liquid byproduct is produced, known as pitch. The pyrolysis vapor products from each of the two reaction stages may then be combined and separated, as will be described further below.

In some embodiments, pyrolysis reaction trains may include multiple first stage reactors in parallel and multiple second stage reactors in parallel. Due to the conversion and recovery of pyrolysis gasses from the first stage reactor, and the associated decrease in liquid/polymer melt volumes, the unconverted residue from two, three, four or more first stage reactors may be fed to a single second stage reactor. Accordingly, a reactor train having four, six, or eight first stage reactors may provide a polymer melt effluent fed to two, three, or four second stage reactors, for example.

Associated with the heating, the molten plastic may be broken down into short-chain petroleum hydrocarbons that can be recovered and separated in the separation system. Desirably, embodiments herein produce a pitch product, and thus limit the amount of coke or char formed by pyrolysis of the plastics. Heating of the molten plastic within the pyrolysis reactor may be limited or controlled such that less than 1 wt % of the waste plastic is converted to coke or char in some embodiments; less than 0.5 wt % in other embodiments; and less than 0.2 wt % in yet other embodiments. Limiting char formation may provide for long reactor run lengths as well as production of a more valuable and consistent pitch product. A control system may be provided to control the pyrolysis reactor heating system, providing a heating profile or heating temperature preferential to the production of the pitch product and below a temperature at which any significant char or coke will form.

The pyrolysis oil recovered from the pyrolysis reactor may be fed to a separation system for separating the pyrolysis reaction effluent into two or more fractions. The separation system may include one or more distillation columns. A pre-flash drum may also be provided to separate the pyrolysis reactor effluent into a liquid feed and a vapor feed fed to the distillation column(s). In some embodiments, the pyrolysis reaction products recovered from the pyrolysis reactor may be separated, based on boiling points, into a pyrolysis gas fraction, a light pyrolysis oil fraction, a medium pyrolysis oil fraction and a heavy pyrolysis oil fraction.

To facilitate mixing and melting of the polymer, embodiments herein may include a flow splitter, disposed intermediate the melt tank outlet and the pyrolysis reactor inlet, configured to divide the molten plastic into a first portion and a second portion. The first portion may be fed to the pyrolysis reactor inlet. The second portion may be fed to a mixing system configured to mix the second portion of the molten plastic with the waste plastic. The mixing system may be configured as a part of the waste plastic feed system, such as by mixing the waste plastic solids with the molten plastic in a screw conveyer; in other embodiments, the mixing system may be disposed upstream of the melt tank inlet and downstream of the waste plastic feed system.

In some embodiments, intermediate recovery from the pyrolysis reactor and the separation system, the pyrolysis reaction effluent is quenched. For example, in some embodiments, the light pyrolysis oil, the medium pyrolysis oil or the heavy pyrolysis oil may be used as a quench medium, lowering the temperature of the pyrolysis reactor effluent and slowing or halting any post reactions that may otherwise occur during transport to the separation system. In this manner, over-cracking of the plastics and excessive production of pyrolysis gas may be avoided, providing for a higher liquid pyrolysis oil recovery. Systems herein may thus include a flow splitter (which may be a simple tee or pipes with associated valving) for dividing the medium or heavy pyrolysis oils into a first portion and a second portion, as well as a quench system for mixing one of the portions with the pyrolysis reaction products recovered from the pyrolysis reactor.

Furthering the transportability of the molten plastic recovered from the melt tank, processes herein may include mixing the molten plastic with a portion of the heavy or medium pyrolysis oil. For example, the heavy pyrolysis oil may be divided using a flow splitter, and a portion of the heavy pyrolysis oil may be recycled as a diluent and mixed with the molten plastic in a mixing system (which may be a flow tee, static mixer, or small agitated vessel, for example). In other embodiments, for example, the medium pyrolysis oil may be divided using a flow splitter, and a portion of the medium pyrolysis oil may be recycled as a diluent and mixed with the molten plastic in a mixing system. The mixing system may be disposed downstream of the melt tank and upstream of the pyrolysis reactor. In some embodiments, the mixing system is disposed intermediate the melt tank and the molten plastic flow splitter.

In some embodiments, the heavy oil product, or a portion thereof, may be sold as a product. In other embodiments, such as where a reactor train includes a first stage reactor and a second stage reactor, the heavy oil stream may be advantageously processed in the second stage reactor, further converting the heavy oil stream to lighter products. Even with the higher severity conditions in the second stage reactor, however, the heavy oil product yield can be up to 20 wt % of the feed or higher.

To limit the heavy oil product yield, in yet other embodiments, the heavy oil product, or a portion thereof, may be fed to and processed within a separate thermal cracking reactor, converting the heavy oil product through a high severity liquid phase thermal cracking heater, whereby high conversion of this stream may be obtained. The resulting thermally cracked effluent may then be fed to the separation system for separation of the cracked products along with the plastics pyrolysis reactor effluent(s). In addition to limiting the quantity of low-value heavy oil product produced, a further advantage of the liquid phase thermal cracking is that the resulting heavy oil recovered in the separation zone and fed to the melt section as a diluent is more aromatic. The higher aromatic content of the heavy oil may thus have increased plastic solubility capabilities, thereby improving the melt plastic rheology, improving melt section operations, heat transfer, and reducing melt section fouling tendencies.

Feeds to the thermal cracking reactor may include heavy oil recovered from the product separations. In some embodiments, feeds to the thermal cracker may include both heavy oil recovered from product separations as well as the unconverted materials (pitch or pyrolysis residue or partially converted plastic) recovered from the plastic pyrolysis reactors.

Liquid phase thermal cracking reactors useful in embodiments herein may include a high temperature filtration system to remove any particulates. In one or more embodiments, the reactors may be thermal cracking heaters where the reactions occur in a tubular coil externally heated to elevated temperatures. In some embodiments, a combination of a thermal cracking heaters followed by a soaking drum may be used. These embodiments may increase reaction residence time and facilitate operating the thermal cracking heater at reduced temperature. In other embodiments, bubbling bed reactors where reactions occur within a vessel with upward flow may be used. In yet other embodiments, the reactor may include a quench system using pyrolysis light or medium fractions to stop any post reaction may be used. Such quench system may limit the production of undesired light gases such as methane.

A pitch purge stream may be provided to avoid buildup of pitch within the system. Prior to conversion in the thermal cracking reactor in some embodiments herein, the heavy oil or combined heavy oil and pitch (or partially reacted plastic) stream may be filtered to remove any undesirable solids that may promote fouling of the thermal cracking reactor. The pitch purge stream in such an embodiment will contain both heavy oil and pitch and may be recovered upstream or downstream of filtration. In other embodiments, the heavy oil or the combined heavy oil and pitch stream may be vacuum flashed or vacuum distilled to minimize the heavy product and purge any thermal tar, feeding the distillate vacuum gas oil to the thermal cracking heater for processing as described above.

In some embodiments, a heat exchanger is also provided on the flow line transporting molten plastic from the melt tank to the pyrolysis reactor. The heat exchanger may be configured to heat or maintain a temperature of the molten plastic, to maintain flowability to the downstream systems. Heating may also be required following admixture of the molten plastic with a recycled medium or heavy pyrolysis stream to maintain the molten plastic at a desired temperature.

As outlined above, heat exchange systems herein may include a melt tank having a heating jacket and heating coils, a nitrogen heater, and a molten plastic heat exchanger. Heat may be provided to each of these using a heat exchange medium. The heat exchange medium may be heated, for example, using a fired, solar, or electrical heating system. Fuel may be supplied to the fired heating system, and may be an external fuel supply, or may be an internal fuel supply, such as the pyrolysis gas recovered from the separation system. The heat exchange medium may be provided via a closed-loop system, the heat exchange medium being circulated from the fired heater, for example, to each respective user at a desired rate, and then back to the fired heater for continued heating, circulation, and use.

For systems processing chlorine- and other halogen-containing polymers, such as PVC, embodiments herein may include a chemical injection system for providing reagents that will react with and facilitate removal of the halogens. Inorganic and organic chloride and other halides (fluorides, bromides) are regularly present in all types of plastics, typically but not limited to being present as additives, binders, flame retardants, and residual catalysts. These halides get partly removed by dissociating in the melt tank to form hydrogen chloride or fluoride or bromide, recovered as vent gases from the melt tank or from a melt vapor separator and treated using a chloride removal system. The remaining halogens may be removed using in-situ alkaline chemical injection. The chemical injection may be into the polymer melt, such as upstream of or directly into the pyrolysis reactor. The alkaline chemical, which is typically but not limited to anhydrous lime, caustic soda, aluminum oxide, calcium carbonate, or magnesium oxide, is used for this purpose. For example, a slurry phase solution of the alkaline chemical is prepared and injected into the pyrolysis reactor where temperatures in the range from 260° C. to 540° C. (about 500° F. to about 1000° F.) and residence times ranging from 5 min to 60 min are provided to react organic halides with the alkaline chemical to form salts that are thereby removed from the pyrolysis product oil and gas. Generated alkaline salts and unreacted alkaline chemical are extracted from the pyrolysis reactor bottoms along with pitch.

In some embodiments, the alkaline chemical injection system may include a lime feed system for forming a lime slurry. The lime slurry may be formed, for example, by mixing lime with a portion of the heavy or medium pyrolysis oil. The lime slurry may then be fed to a mixing system for mixing the lime slurry with the molten plastic. The lime mixing system may be disposed upstream of the pyrolysis reactor, and in some embodiments is disposed downstream of the molten plastic flow splitter. In the flow lines and the pyrolysis reactor, the lime may react with chlorine contained in the molten plastic, producing calcium chloride, which may be recovered with the pitch product from the pyrolysis reactor. Other alkaline chemical injection reagents may be used in a similar manner.

A simplified process flow diagram of a thermochemical process according to embodiments herein is illustrated in FIG. 1. A plastic waste feed 2 may be fed to a melt zone 4 producing a polymer melt fed to and converted within plastics pyrolysis reaction area 5. The plastics may be converted to a pyrolysis oil, which may include various hydrocarbons, such as light (C1 to C4) hydrocarbons, naphtha range hydrocarbons, diesel range hydrocarbons, and heavier hydrocarbons, possibly up to pitch. The pitch may be recovered as a byproduct stream 28, and the remaining conversion products may be recovered as a pyrolysis oil 30. The pyrolysis oil 30 may then be fed to a distillation and separation area 7 for separating the pyrolysis oil into various hydrocarbon fractions, such as the aforementioned light hydrocarbons 42, naphtha 44, diesel or light oil fraction(s) 38, and heavy oil fraction 40. A portion or whole of the light hydrocarbons 42, such as C1 or C1-C2 or C1 up to C3, C4, C5, C6, or C7 hydrocarbons, may be recycled to the pyrolysis reaction area 5 for use as a fuel for burners (not illustrated) associated with the reactor and/or heaters (also not illustrated). Heavier products may also be recycled, as or if necessary, to the pyrolysis reaction area 5; for example, the naphtha, diesel, or heavy oil fraction(s) may be fed to the pyrolysis reaction area 5 and used as a diluent stream or a quench stream, as will further described below.

As described above, the reaction zone 5 may include one or more reactors in series and/or in parallel. In some embodiments the reactor area 5 may include a single stage reactor producing a pyrolysis oil, recovered as a vapor, and an unconverted (pitch) fraction. Other embodiments may include two or more reactors in series or parallel, or three or more reactors in series and parallel, such as two first stage reactors feeding unconverted materials to a single second stage reactor. Similarly, the separation zone 7 may include one or more separators (flash drums, strippers, distillation columns, etc.) in series and/or in parallel. As such, the general flow scheme described for FIG. 1, as well as for other figures herein, is not limited based on reactor configuration or separation configuration, and even where a two-reactor configuration or a single separator configuration is illustrated or described, embodiments herein contemplate similar flow schemes for single or multiple reactor systems and single or multiple separator configurations.

Referring still to FIG. 1, describing the illustrated flow scheme in more detail, shredded plastic 2 may be transferred to a feed area located near the top of the melt tank 4. The plastic is then directed to the melt tank 4 through a feedstock auger (not shown). In some embodiments the feedstock auger may be replaced with or additionally include an extruder, and plastic feedstock may be heated by the action of the extruder. Prior to being fed to the melt tank, the shredded plastic may be combined with a portion of recycled molten plastic 8 from the bottom of the melt tank. The combined plastic feed is then heated within the melt tank, such as to a temperature of 232° C. to 343° C. (450° F. to 650° F.), for example 300° C. (573° F.). The melt tank may be brought up to temperature by the use of hot thermal fluid or molten salt circulating through the exterior tank jacket (not shown) as well as internal coils (not shown) of the melt tank. Alternatively, the tank may be heated by an electrical heating element, or by circulating hot flue gas in a heating jacket. The molten plastic may be thoroughly mixed by an internal melt tank agitator (not shown).

In some embodiments, the molten polymer 6 may then be recovered from melt tank 4, pumped, and further heated in a melt heat exchanger (not shown) against hot thermal fluid and fed to a melt vapor separator (not shown). Feed temperature to the separator may be set by controlling the amount of hot thermal fluid to the melt heat exchanger. Any vapors produced in the melt tank may be recovered as an off-gas 14 separated from the molten polymer. In some embodiments, heavy pyrolysis liquid product 40A and/or medium pyrolysis liquid product 38B may be used as a diluent, added to the molten plastic inside the melt tank or at suitable locations upstream of the pyrolysis reaction area 5. This diluent also provides heat directly into the plastic melt, supplementing the total heat duty required to melt solid plastic. The concentration of recycle diluent may be varied to optimize heat input and maintain melt plastic flow.

A first portion 10 of the molten plastic may then be directed to the inlet of the first stage pyrolysis reactor 12, where it may be further heated and pyrolyzed. A second portion 8 of the pumped molten plastic, such as after being heated in a melt heat exchanger (not shown), may be recycled back to the melt tank and combined with fresh plastic from the feeding package. The portion returned to the melt tank may be recovered in some embodiments after mixing with the medium or heavy pyrolysis liquids (38B, 40A).

Any vent gases 14 recovered from the melt tank and/or from the melt vapor separator (not shown) may be combined and directed to a chloride removal system (not shown). The chloride removal system may include a caustic wash tower or a water wash tower to either completely neutralize the hydrogen chloride or create a byproduct of hydrochloric acid (not illustrated). Chloride may be present in the vent gas stream(s), and it may be desirable to remove the chloride before combining the resulting vapors 14A with the overhead vapor 34 from the separation column fed to the overhead condenser 36.

The molten plastic 10 may be fed slowly to a feed distributor (not shown) in the first stage plastics pyrolysis reactor 12, where molten plastic is heated and converted. Alkaline reagents may also be introduced to the pyrolysis reactor. The molten plastic may be heated up to a temperature, for example, in the range from about 350° C. to 677° C. (about 662° F. to about 1250° F.), such as from 370° C. to 550° C. (about 700° F. to 1022° F.), and at a pressure in the range from about 4 psig to about 20 psig, such as about 6 psig, by hot flue gas, from gas burners, circulating through the exterior jacket. Associated with the heating, the molten plastic may be broken down into short-chain petroleum hydrocarbons that can be separated in the distillation and separation area 7.

The first stage plastics pyrolysis reactor according to some embodiments herein may be divided into two zones, including a first (heating) section and a second (reaction) section. The first section may contain a preheat zone, targeting a temperature rise to second stage reaction conditions while providing a low conversion, such as 5-20% conversion, for example 10% conversion, and a reaction section targeting 30%-80% conversion, for example 40%-70% conversion, such as about 60% conversion (weight basis). The second section is a liquid product maximization zone, operating at the temperatures noted above, where the final conversion completes with a longer residence time. Temperatures in the second section may be controlled to avoid coking, favoring the production of a liquid pitch product. A lower pyrolysis reactor agitator (not shown) mixes the pitch product and may also remove any solids on the wall and bottom of the reactor.

The pyrolysis oil may be recovered from reactor 12 via flow stream 16. In some embodiments, a pyrolytic vapor product 16 is withdrawn from the pyrolysis reactor 12, where it is quenched in a pyrolysis reactor vapor quench mixer with a portion of the cooled medium pyrolysis cut liquid 38A, recovered from the side draw 38 of the separation column 32. The quenched pyrolytic vapor 18 is then sent to a pre-flash drum (not shown) prior to being fed to the separation column 32. Unconverted residue 20 from the first section is directed to the second reaction section 22 where conversion is further increased, producing a second pyrolytic vapor product 24 and a heavy residue liquid by-product 28, pitch. Vapor products from the two reaction sections are individually or combined to form stream 30, as illustrated, and fed to the separation zone 32 to be separated as required, depending on the end destinations of the products. When fed individually, the second pyrolytic vapor product 24 may also be quenched.

In embodiments that do not further process the pitch, to prevent build up within the reactor, the hot pitch product 28 from the bottom of the reactor is removed and sent to a pitch drum (not shown) via the pyrolysis reactor 22 bottoms auger (not shown). The pitch product 28 from the pyrolysis reactor may be cooled by mixing with a slipstream (not shown) of heavy pyrolysis cut liquid from the pre-flash drum (not shown) which in part also reduces the viscosity of the pitch product. The pitch drum may be cooled by ambient air to below 205° C. (below about 400° F.) but above the softening point.

In some embodiments, the separation system 7 may include one or more distillation columns. In some embodiments, the separation system 7 may include a pre-flash drum and one or more distillation columns, among other components. The quenched pyrolysis products 18, 24 from the overhead of the pyrolysis reactor(s) 12, 22 may be fed to a pre-flash drum (not illustrated) in the distillation and separation area 7. Any heavy pyrolysis cut liquid that drops out from the pre-flash drum may be pumped and combined with separation column 32 bottoms 40. A portion of this heavy pyrolysis cut liquid from the pre-flash drum may also be sent back to the pitch drum (not illustrated) to cool and reduce the viscosity of the pitch product from the pyrolysis reactor, as noted above. The overhead of the flash drum is fed to the separation column as the feed. The separation column of some embodiments may include valve trays in the top section, a packed bed in the middle section and baffle trays in the bottom section. The primary purpose of the column is to separate the pyrolysis reactor effluents 16, 24 (18, 30) into pyrolysis gas 42, light pyrolysis cut 44, medium pyrolysis cut 38, and a heavy pyrolysis cut 40.

The gross overhead vapor 34 of separation column 32 may be combined with treated vent gas stream 14A from the caustic drum (not shown) which are then partially condensed against cooling water in the overhead condenser before it enters the reflux drum 36. The light pyrolysis liquid cut from the reflux drum is then pumped by the light pyrolysis cut pumps where a portion 44R is sent as reflux back to the top of the column. The remaining light pyrolysis product 44 is recovered as a product, and, in some embodiments, antioxidant is injected into this stream. In some embodiments, light pyrolysis product may be withdrawn as a side draw from an upper tray of the separation column, and in such embodiments the column may operate at total reflux.

Any light hydrocarbons and non-condensables 42 from the reflux drum 36 may be sent to a pyrolysis gas compressor package (not shown) where it is compressed and then cooled. The cooled pyrolysis gas may then be sent to the pyrolysis gas accumulator (not shown) where it may be mixed with fuel gas makeup, such as may be required during startup and shutdown. The off-gas from the accumulator may then be sent to the thermal fluid package (not shown) and pyrolysis reactor burners (not shown) to be used as a fuel gas for embodiments having fuel-fired heaters.

The medium pyrolysis cut product is withdrawn as a side draw 38 from the middle section of the separation column 32. The medium pyrolysis product 38 is then pumped where a portion may be recycled back to the separation column to wash the vapor feed prior to being cooled. A medium pyrolysis cut cooler (not illustrated) may be used to cool the remaining balance, and a portion 38A of the remaining balance may be recycled back to the pyrolysis reactor vapor quench mixer to be used as quench liquid for the pyrolytic reactor vapors. The remaining portion may be recovered as a product, with a provision to inject antioxidant into this stream.

The columns reboiler duty may be provided by circulating hot thermal fluid in a reboiler (not shown). A heavy pyrolysis cut product 40 from the columns bottom, which is a mixture of heavy hydrocarbons, may be pumped then combined with heavy pyrolysis cut from the pre flash drum and cooled by a heavy pyrolysis cut cooler (not shown) prior to being sent to storage.

As noted above, a portion 40A of the heavy pyrolysis cut product 40, and/or a portion 38B of the medium pyrolysis cut 38 may be recycled back to the melt tank or suitable location at the melt section and mixed with the molten plastic recovered from the melt tank 4.

The pyrolysis gas 42, or a portion thereof, may be used to fire burners in the hot thermal fluid heating system (not shown) and the pyrolysis reactor burners (not shown). However, the raw pyrolysis gas may contain olefins and diolefins. In some embodiments, the raw pyrolysis gas can be refrigerated and then fractionated to recover all compounds heavier than C2s or C3s. In other embodiments, the entire raw pyrolysis gas product stream 42 may be compressed and recovered as a product.

Embodiments herein rely on thermochemical decomposition (pyrolysis) of plastic feedstocks to produce various grades of gas and liquid products. Solid plastic particles are introduced into a melt tank followed in series by a reactor. Each of these vessels are thermally heated. In the case of the melt tank, heat is provided by a circulating hot thermal fluid stream. The reactor may be thermally heated by a series of gas fired burners that provide direct impingement of the burner flue gases against the vessel wall that may be jacketed with a low melting point metal. The metal inside the jacketing melts to provide uniform heating.

The thermal mechanism of the process is essentially non-catalytic and breaks the polymeric bonds in the plastic feedstocks by thermal disruption. The extent of the thermal decomposition is related to the temperatures of the melt tank and the reactor(s). In general, the higher the temperature the greater the amount of thermal decomposition of the feedstock plastic and the lower the molecular weight of the products (i.e., the polymer chains are broken up into smaller segments with fewer carbon atoms). The process temperature used therefore is a balancing act between being too high (resulting in a higher gas make and lighter low-viscosity liquid products) and being too low (resulting in a lower gas yield and heavier high-viscosity liquid products).

Changes in the composition of the feedstock plastic will affect the preferred temperature for operating the melt tank and reactor(s). In particular, increased amounts of PVC and high-density PP and PE in the feedstock will require the temperature to be increased. Similarly, increased amounts of low-density PP and PE along with reduced quantities of PVC in the feedstock will enable a lower process temperature to be used.

Following melting and pyrolysis, embodiments herein then use fractionation to separate the gas and liquids into the desired product and intermediate streams. Embodiments herein may provide the following product slate: (i) a combustible pyrolysis gas; (ii) a lighter liquid product with physical and chemical properties similar to untreated wild naphtha or gasoline; (iii) heavier liquid products with physical and chemical properties similar to untreated diesel and heavy oil; and (iv) a heavy liquid pitch product that can be blended with asphaltenes from other refinery processes.

One advantage of embodiments herein is its simplicity and flexibility to handle variations in the plastic feedstock composition and capacity. Further, as embodiments of processes herein do not require the addition of any catalysts or additives, the process requires fairly simple primary process controls (i.e., temperature) to govern the product yields and properties.

If required, process temperatures can be adjusted to reflect changes in the composition of the plastic feedstock. At the same time, the amount of PVC and PET in the plastic feedstock may desirably be minimized. PVC plastic is more difficult to melt and decompose; the decomposition product also releases chlorine gas (which is vented off the melt tank and then removed by contacting with water). Residual chlorine can also end up contaminating the liquid product streams, which is undesirable. PET decomposition tends to release oxygenates into the product streams, which are also undesirable contaminants.

As described above for FIG. 1, there are two reactions sections in series, followed by a light gas (e.g., LPG) recovery/fuel gas separation section, and a liquid product separation section. Sometimes the gas products are further separated to produce a fuel gas and an LPG product. In front of the first reaction section is a melt section to melt the incoming shredded plastic, providing melting and limited conversion of the shredded waste plastic feed. To aid in the waste plastic feed a heavy oil recycle stream may be mixed with the incoming waste plastic feed within the melt section. This results in recycle of heavy oil through the pyrolysis section. Typically, 50 to 70% of the overall conversion occurs in the pyrolysis first stage section. Unconverted residue from the first section is directed to the second reaction section where conversion is further increased and a heavy residue liquid by-product (pitch) is produced. Conversion products from the two reaction sections are combined and separated as required depending on the end destinations of the products. Typically, the light gaseous products will be used for process fuel and a wide boiling range liquid product sold.

For sales to liquid feed ethylene crackers, for example, a heavy oil product, which is also used to assist in melting the shredded plastic feeds, is sold as a separate product. However, markets are often limited for this plastics-derived product and in many situations will be sold at a heavy discount compared to the value of the other liquid products when sold to ethylene crackers directly.

The heavy oil stream can also be directed to the plastic pyrolysis reactor section second stage which will have a higher conversion rate than if the heavy oil stream is directed to the first stage, as a significant fraction of the heavy oil stream directed to the first stage is flashed off with first stage products and the second stage operates at a higher temperature and severity. This is a unique configuration that enables this operation. However, the severity in the second stage in embodiments herein may not be sufficient to fully convert the heavy oil product to lighter products. Consequently, the heavy oil product yield may be 10-20 wt % of the feed. The embodiments illustrated in FIGS. 2-5 may increase, maximize, or fully convert this heavy oil product to improve the production of higher value crackable feedstocks and thus the value of products resulting from systems herein.

Figure 2:
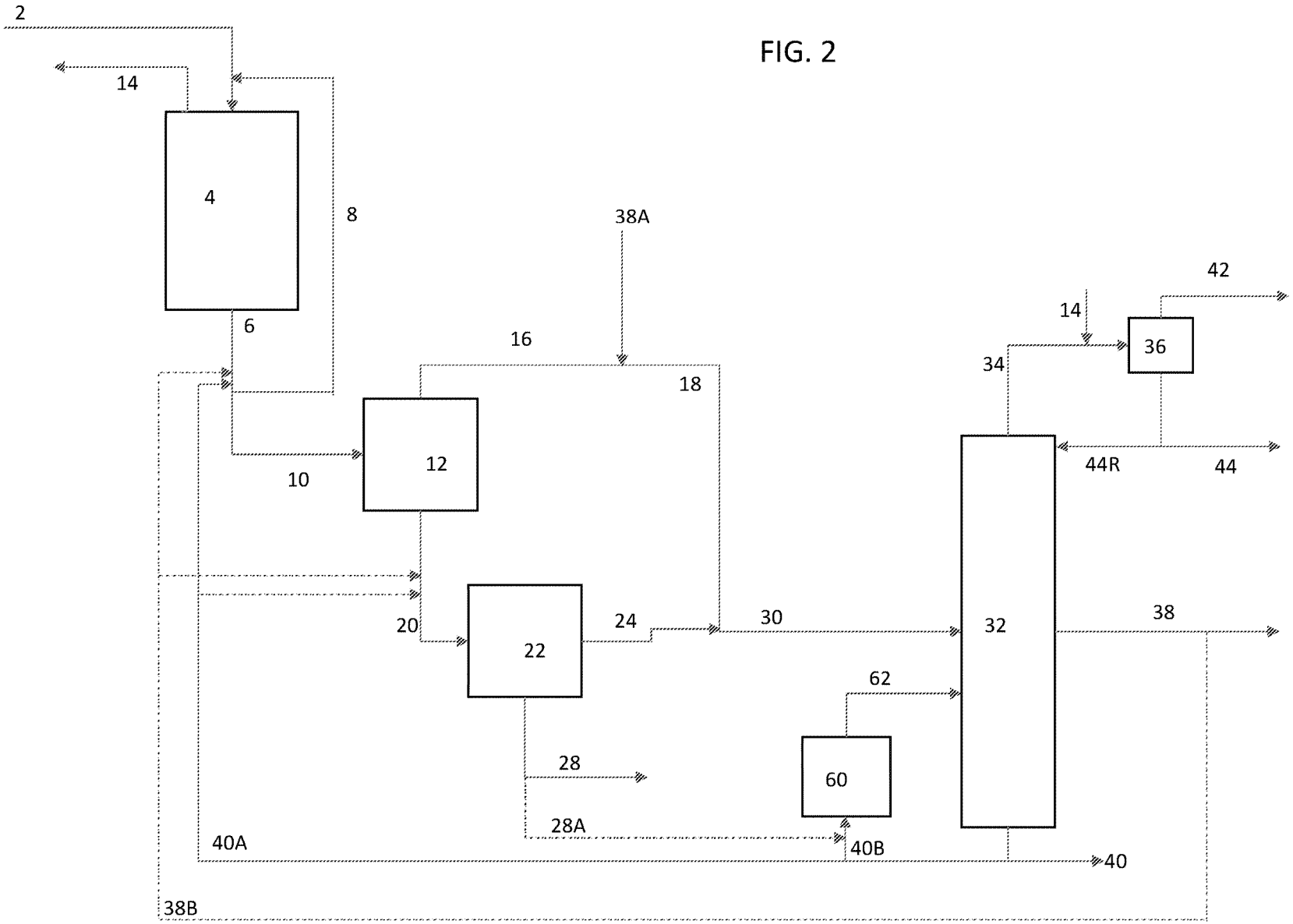
FIG. 2 illustrates a simplified process flow diagram of a system for plastics pyrolysis according to one or more embodiments disclosed herein.

Referring now to FIG. 2, a simplified process flow diagram of systems for converting plastic waste according to embodiments herein is illustrated, where like numerals represent like parts. As described with respect to FIG. 1, the waste plastic feed 2 may be melted in melting tank 4 and fed to reactor(s) 12, 22. The resulting pyrolysis oil, recovered as vapor products 16, 24, may then be separated to result in the aforementioned light gas fraction 42, naphtha fraction 44, medium oil or diesel fraction 38, and heavy oil fraction 40.

Similar to the embodiment of FIG. 1, a portion 40A of the heavy pyrolysis oil 40 may be recycled for admixture with the polymer melt being fed from the melt tank 4 to the first stage reactor 12 and/or the polymer melt being fed from the first stage reactor to second stage reactor 22. Additionally, as illustrated in FIG. 2, a portion 40B of the heavy pyrolysis oil may be fed to and processed within a thermal cracking reactor 60, converting the heavy oil product through a high severity liquid phase thermal cracking heater, whereby high conversion of this stream may be obtained. The resulting thermally cracked effluent 62 may then be fed to separation system 32 for separation of the cracked products along with the plastics pyrolysis reactor effluent(s). In addition to limiting the quantity of low-value heavy oil product produced, a further advantage of the liquid phase thermal cracking and common separation train is that the resulting heavy oil recovered in the separation zone and fed to the melt section as a diluent is more aromatic. The higher aromatic content of the heavy oil may thus have increased plastic solubility capabilities, thereby improving the melt plastic rheology, improving melt section operations and reducing melt section fouling tendencies.

Figure 3:
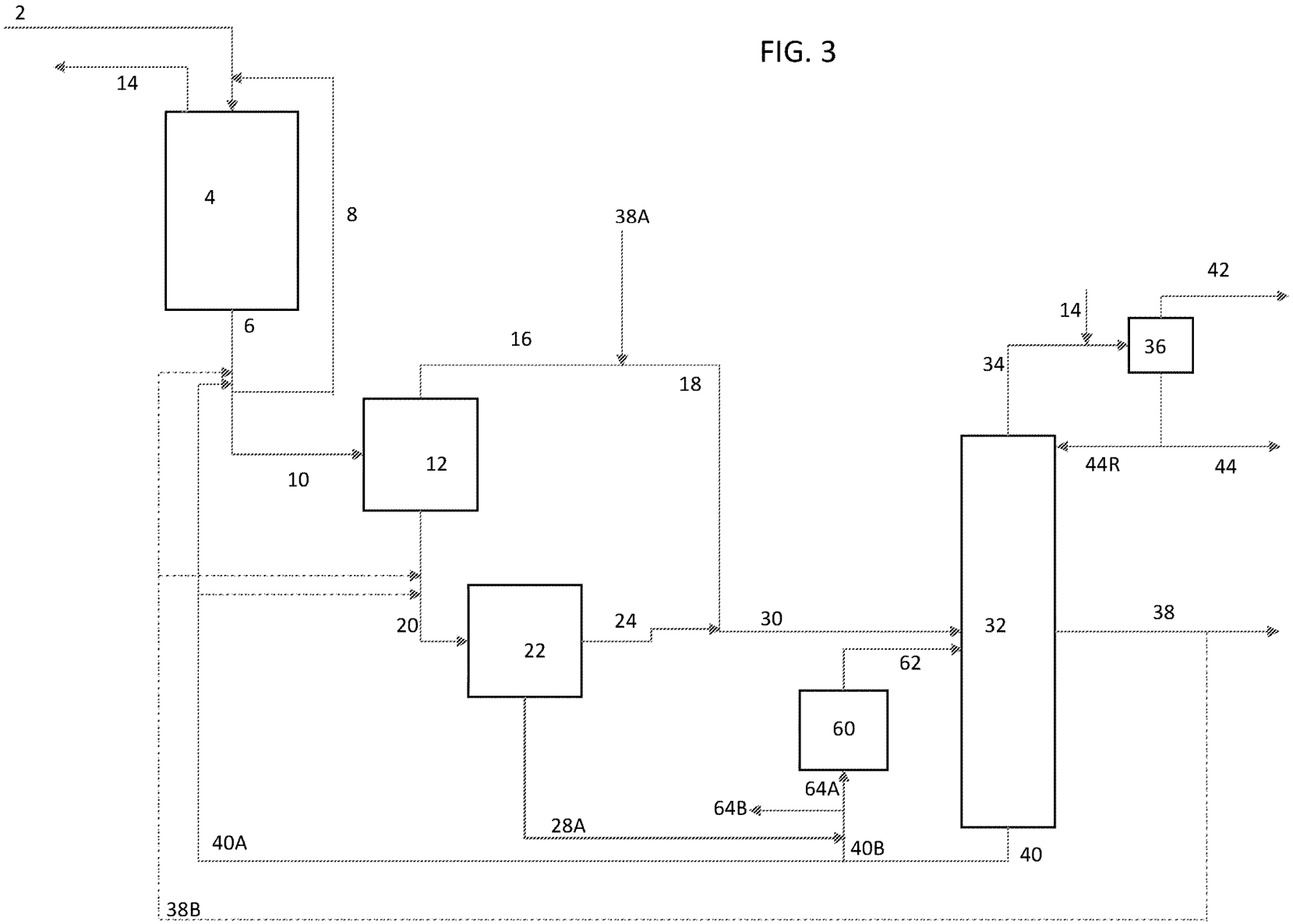
FIG. 3 illustrates a simplified process flow diagram of a system for plastics pyrolysis according to one or more embodiments disclosed herein.

In some embodiments, a portion 28A of the pitch fraction 28 recovered from the reaction zone may also be fed to the liquid phase thermal cracking reactor 60. Alternatively, as illustrated in FIG. 3, the pitch stream 28A may be combined with heavy pyrolysis oil fraction 40B, the pitch purge being recovered as a portion 64B of the combined stream. To limit fouling, the heavy oil or the combined heavy oil and pitch stream fed to the liquid phase thermal cracking reactor 60 may be filtered in a filter (not shown) to remove any undesirable solids.

In the flow scheme shown in FIGS. 2 and 3, the heavy oil product is converted to desirable ethylene cracker feedstocks. This is accomplished by the thermal cracking of the heavy oil product in a thermal cracking section. With this flow scheme, the heavy oil product is converted through a high severity liquid phase thermal cracking heater, whereby high conversion of this stream is obtained through a recycle design whereby the conversion per pass is controlled to minimize any potential fouling in the thermal cracking equipment and maximize product selectivity towards ethylene cracker liquid feedstocks. To further protect against fouling of the thermal cracking equipment, the heavy oil feed may be filtered to remove undesirable solids.

The operating pressure, temperature, and residence time of the thermal cracking reaction of heavy oil can be independently controlled in this configuration relative to simply recycling the heavy oil product back to the pyrolysis section. This facilitates efficient conversion of the heavy oil product at the required higher severity process conditions compared to the feed's pyrolysis section. Due to the design of the thermal cracking heater, it is important that the reactions occur in a liquid phase reaction, thus the pressure of this reactor is higher (14 bar to 36 bar; about 200-500 psig) compared to that in the plastics pyrolysis reaction section (1.3 to 1.7 bar; about 5-10 psig). Additionally, the temperature is also higher (490-520° C. vs 400-450° C.), and the residence time is lower compared to the operating conditions in the plastics pyrolysis reactors. Residence time is lower and is important to control to limit over-cracking of products to undesired lighter gases like methane.

Effluents from the thermal cracking heater are quenched then combined with the first stage reaction section's residue vapor products and the combined stream is directed to the product separation section. Part of the heavy oil combined product from the separator is directed to the melt section and optionally directly to the pyrolysis second stage reaction section for partial further conversion and separation. As a result of this recycling of heavy oil product, any thermal tar produced in the thermal cracking heater will be concentrated in the second stage residue (pitch) product.

Figure 4:
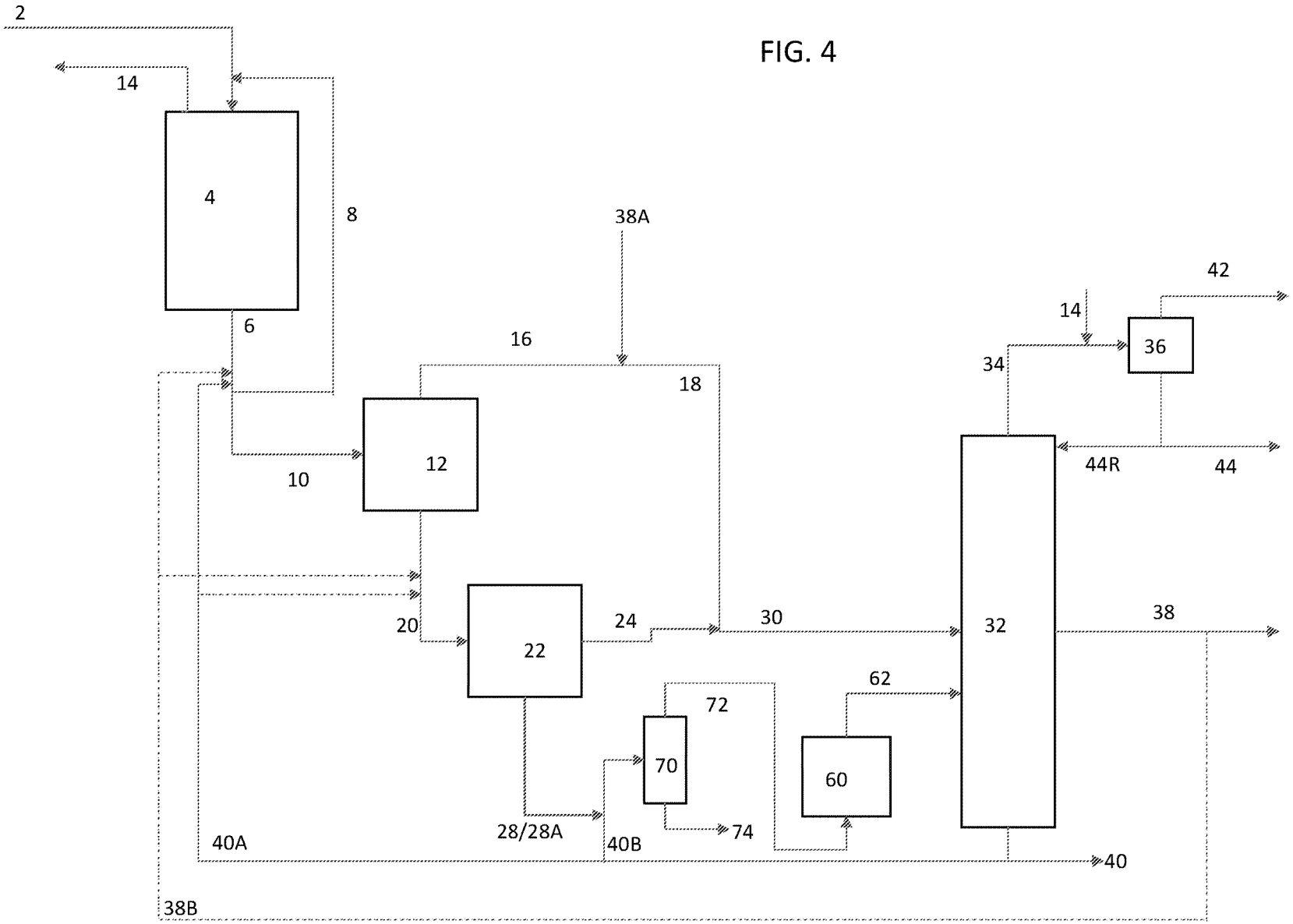
FIG. 4 illustrates a simplified process flow diagram of a system for plastics pyrolysis according to one or more embodiments disclosed herein.

Referring now to FIG. 4, a simplified process flow diagram of systems for converting plastic waste according to embodiments herein is illustrated, where like numerals represent like parts. This embodiment is similar to the embodiment of FIGS. 2 and 3 in that a portion 40B of the heavy pyrolysis oil is thermally cracked. The heavy oil or the combined heavy oil 40B and pitch stream 28 may be vacuum flashed or vacuum distilled in a vacuum separator 70 to minimize the heavy product and purge any thermal tar 74, feeding the distillate vacuum gas oil 72 to the thermal cracking heater 60 for processing as described above.

FIG. 4 is an alternate configuration to that shown in FIG. 3. One difference is that the combined pitch and heavy oil product stream is split with one part sent directly to the thermal cracking section and the second part vacuum flashed to recover convertible heavy oil lighter components for further conversion through the thermal cracking section. A filtered pitch product that has a reduced amount of vacuum flashed material is then produced, which may be suitable for sales as a low sulfur heavy fuel oil or blend stock.

Figure 5:
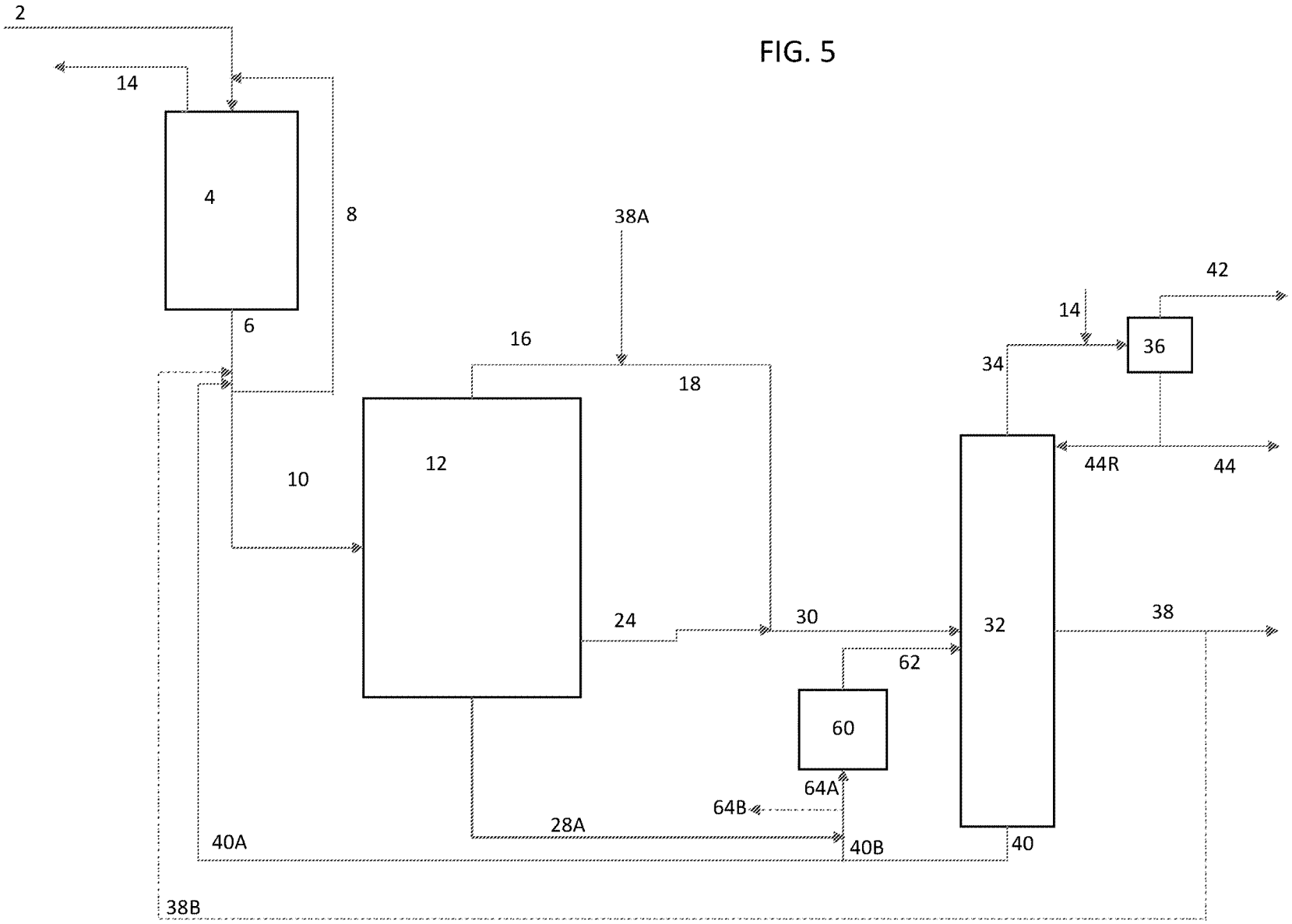
FIG. 5 illustrates a simplified process flow diagram of a system for plastics pyrolysis according to one or more embodiments disclosed herein.

Referring now to FIG. 5, a simplified process flow diagram of systems for converting plastic waste according to embodiments herein is illustrated, where like numerals represent like parts. The process of FIG. 5 is similar to that of FIG. 3, simply illustrating the process as provided with a single stage reactor 12 (no second stage reactor in this embodiment). As noted above, it is also contemplated that other embodiments illustrated and/or described herein, such as the embodiments of FIGS. 1, 2, and 4, among others, may include a single stage reactor.

FIGS. 3 and 5 are each an alternative flow scheme to FIG. 2 where the feed to the thermal cracking section is a combination of heavy oil recycle and the first stage(s) plastics pyrolysis reactor residue product. The thermal cracking products are separated in the common product separator. The thermal cracking feed is also filtered to ensure high reliability of the thermal cracking section. A filtered heavy oil stream is also produced to purge out any unconvertable material. This alternate flow scheme has the benefit in that the second stage pyrolysis section is eliminated, thereby reducing the overall flow scheme's cost. Additionally, it further increases the overall conversion due to the first stage residue passing first through the higher severity thermal cracking section. This further increases the overall processes thermal efficiency and reduces operating costs.

Embodiments herein also contemplate processing a heavy plastics pyrolysis oil feedstock (not shown) as an additional feed to the separation system 32 and/or the liquid phase thermal cracker 60. For applications where two or more sites have plastic pyrolysis or other waste stream pyrolysis oils operations, the other sites full range pyrolysis oil can be sent to systems herein where the thermal cracking section is located. Combined pyrolysis oils are then optimized for the end destinations.

As described above, embodiments herein are directed toward processes and systems for the conversion of waste polymeric materials to useful petrochemicals, fuels, and other intermediates and products. Advantageously, embodiments herein produce a pitch product, rather than tar or coke, and operate at temperatures and conversions allowing for production of a high-quality pyrolysis oil. Further advantages may include enhancing overall conversion in a liquid phase thermal cracking reactor. Additionally, the conversion in the liquid phase thermal cracking reactor and common separations may enhance the aromatic content of the produced medium and/or heavy pyrolysis oil products, providing for improved solubility, mixing, and dissolution of the incoming plastics in the melt section and in the reactors.

Embodiments herein may further provide for increased yields of higher value products through reduction and or elimination of lower value heavy fractions and may maximize production of lighter liquid products suitable as ethylene cracker feedstocks. For example, raw yields of heavy products such as a vacuum gas oil fraction may be significantly decreased or negated, favoring production of lighter products, such as naphtha and gas oil. Further, embodiments herein may produce pyrolysis products that are also more readily hydrotreated, which lowers the cost of hydrotreating. Further still, embodiments herein may provide for a high thermal efficiency of the overall process, and may increase the percentage circularity of the process in terms of amount of waste plastic being converted to fresh plastic for re-use.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed as new and desired to be protected by Letters Patent is:

1. A process for converting waste plastics to hydrocarbon products, comprising:

heating a waste plastic to form a heated molten plastic;

feeding the heated molten plastic to a plastics pyrolysis reaction zone;

in the plastics pyrolysis reaction zone, heating the heated molten plastic to a pyrolysis temperature, producing a pyrolysis oil product and a liquid pitch product;

feeding a heavy pyrolysis oil to a thermal cracking heater;

in the thermal cracking heater, thermally cracking the heavy pyrolysis oil while maintaining the heavy pyrolysis oil in a liquid phase to form a thermally cracked product;

separating the pyrolysis oil product and the thermally cracked product into a pyrolysis gas fraction, a light pyrolysis oil fraction, a medium pyrolysis oil fraction, and a heavy pyrolysis oil fraction; and feeding a first portion of the heavy pyrolysis oil fraction as the heavy pyrolysis oil fed to thermal cracking heater.

2. The process of claim 1, comprising mixing a second portion of the heavy pyrolysis oil fraction with the heated molten plastic upstream of the plastics pyrolysis reaction zone.

3. The process of claim 1, wherein the plastics pyrolysis reaction zone comprises a first stage pyrolysis reactor and a second stage pyrolysis reactor, the process comprising:

in the first stage pyrolysis reactor, heating the heated molten plastic to a first pyrolysis temperature, producing a pyrolysis vapor product and a partially converted molten plastic;

mixing a third portion of the heavy pyrolysis oil fraction with the partially converted molten plastic to form an intermediate heavy feed mixture;

in the second stage pyrolysis reactor, heating the intermediate heavy feed mixture to a second, higher, pyrolysis temperature, producing a pyrolysis product and the liquid pitch product; and commonly separating, as the pyrolysis oil product, the pyrolysis product and the pyrolysis vapor product along with the thermally cracked product, to recover the pyrolysis gas fraction, the light pyrolysis oil fraction, the medium pyrolysis oil fraction, and the heavy pyrolysis oil fraction.

4. The process of claim 1, wherein feeding the first portion of the heavy pyrolysis oil fraction comprises:

mixing a portion or an entirety of the liquid pitch product with the heavy pyrolysis oil to form a mixed heavy cracker feed;

withdrawing a portion of the mixed heavy cracker feed as a heavy oil product stream; and feeding a remaining portion of the mixed heavy cracker feed as the heavy pyrolysis oil fed to the thermal cracking heater.

5. The process of claim 1, wherein feeding the first portion of the heavy pyrolysis oil fraction comprises:

mixing a portion or an entirety of the liquid pitch product with the heavy pyrolysis oil to form a mixed heavy cracker feed;

separating, under vacuum, the mixed heavy cracker feed to recover a vacuum distillate and a thermal tar; and feeding the vacuum distillate as the heavy pyrolysis oil fed to the thermal cracking heater.

6. The process of claim 3, comprising:

recovering a first portion of the medium pyrolysis oil fraction as a product; and one or more of:

mixing a second portion of the medium pyrolysis oil fraction with the heated molten plastic;

mixing a third portion of the medium pyrolysis oil fraction with the partially converted molten plastic; and quenching one or both of the pyrolysis vapor product and the pyrolysis product with a fourth portion of the medium pyrolysis oil fraction.

7. The process of claim 1, further comprising filtering the heavy pyrolysis oil upstream of the thermal cracking heater.

8. The process of claim 4, further comprising filtering the mixed heavy cracker feed.

9. A process for converting waste plastics to hydrocarbons, comprising:

in a thermal cracking heater, thermally cracking a heavy pyrolysis oil while maintaining the heavy pyrolysis oil in a liquid phase to form a thermally cracked product;

separating the thermally cracked product and a plastic pyrolysis oil to recover a pyrolysis gas fraction, a light pyrolysis oil fraction, a medium pyrolysis oil fraction, and a heavy pyrolysis oil fraction;

feeding a first portion of the heavy pyrolysis oil fraction to the thermal cracking heater as the heavy pyrolysis oil;

forming a molten plastic from the waste plastics;

mixing a second portion of the heavy pyrolysis oil fraction with the molten plastic to form a molten plastic mixture;

in a plastic pyrolysis reaction zone, heating the molten plastic mixture to a pyrolysis temperature, producing a pyrolysis oil product and a liquid pitch product; and quenching the pyrolysis oil product with a portion of the medium pyrolysis oil fraction to form the plastic pyrolysis oil.

10. The process of claim 9, wherein the heavy pyrolysis oil comprises a mixture of the first portion of the heavy pyrolysis oil fraction and a portion or an entirety of the liquid pitch product.

11. The process of claim 10, comprising:

feeding a first portion of the mixture to the thermal cracking heater as the heavy pyrolysis oil; and recovering a second portion of the mixture as a pitch product.

12. The process of claim 10, comprising:

separating, under vacuum, the mixture to recover a vacuum distillate and a thermal tar; and feeding the vacuum distillate as the heavy pyrolysis oil fed to the thermal cracking heater.

13. The process of claim 1, wherein maintaining the heavy pyrolysis oil in a liquid phase comprises applying a pressure between 14 bar and 36 bar to the thermal cracking heater.

14. The process of claim 9, wherein maintaining the heavy pyrolysis oil in a liquid phase comprises applying a pressure between 14 bar and 36 bar to the thermal cracking heater.

* * * * *